US005358428A

United States Patent [19]

Bixler et al.

[11] Patent Number: 5,358,428

[45] Date of Patent: Oct. 25, 1994

[54] SHIELDED ELECTRICAL CONNECTOR

[75] Inventors: Craig Bixler, Elmhurst; Michael O'Sullivan, Willowbrook, both of Ill.

[73] Assignee: Molex Incorporated, Lisle, Ill.

[21] Appl. No.: 135,198

[22] Filed: Oct. 12, 1993

[51] Int. Cl.[5] ..... H01R 13/648

[52] U.S. Cl. ..... 439/607; 439/906

[58] Field of Search ..... 439/92, 98, 607, 609, 439/610, 906

[56] References Cited

U.S. PATENT DOCUMENTS

| | | | |
|---|---|---|---|
| 4,585,292 | 4/1986 | Frantz et al. . | |
| 5,035,657 | 7/1991 | Hass et al. | 439/607 X |
| 5,052,949 | 10/1991 | Lopata et al. | 439/610 |
| 5,055,070 | 10/1991 | Plegge et al. | 439/609 |
| 5,158,481 | 10/1992 | Frantz | 439/607 |
| 5,171,161 | 12/1992 | Kachlic | 439/607 X |
| 5,199,903 | 4/1993 | Asick et al. | 439/610 |

*Primary Examiner*—Khiem Nguyen

*Attorney, Agent, or Firm*—Charles S. Cohen

[57] ABSTRACT

A shielded electrical connector is provided for interconnection to a multi-conductor cable. The connector includes an insulative housing having a front mating face and a rear conductor-receiving face. A conductive shell is disposed about at least a portion of the housing and has an aperture near the rear face of the housing. A pair of conductive shield halves enclose the rear conductor-receiving face of the housing and define a cavity extending rearward therefrom. The shield halves have hooks for engaging beneath portions of the shell proximate the aperture as the shield halves are rotated about the hooks to form the cavity. A fulcrum projection is operatively associated between the shield halves intermediate the front and rear ends thereof for pivoting the shield halves about the fulcrum projection as the shield halves are rotated about the hooks. Thus, the hooks are urged outwardly to positively engage the portions of the shell to assure an electrical connection between the shield halves and the shell.

15 Claims, 4 Drawing Sheets

SHIELDED ELECTRICAL CONNECTOR

FIELD OF THE INVENTION

This invention generally relates to the art of electrical connectors and, particularly, to a shielded electrical connector having a pair of shield halves pivotally connected to the connector shell.

BACKGROUND OF THE INVENTION

Shielded electrical connectors are used in various applications for shielding electrical terminations from external electromagnetic interference, to prevent the systems which use the connectors from emitting electromagnetic signals and to prevent the connector from emitting electromagnetic signals. The shielded connectors usually continue the shielding of a shielded cable to another shielded cable or to an electronic device.

In some applications involving the use of high frequency electrical signals, shielded electrical connectors actually are required, particularly in such applications as the telecommunications and computer industries. Such high frequency electromagnetic signals are very susceptible to interference from other electromagnetic signals and also generate electromagnetic signals of their own which may be undesirable and interfere with other electronic devices. In fact, various Federal Communication Commission requirements have caused a significant increase in the use of shielded electrical connectors.

The present invention is directed to an improved shielded electrical connector of the type having a pair of mating metal shield members or halves each of which has a forward end engageable with a metal shell. Pivot means are provided for rotating rear ends of the shield halves into engagement with a shielded cable and, in turn, create a positive pressure ground connection between forward ends of the shield halves and the metal shell of the connector.

SUMMARY OF THE INVENTION

An object, therefore, of the invention is to provide a new and improved shielded electrical connector of the character described for interconnection to a multi-conductor cable.

In the exemplary embodiment of the invention, the connector includes an insulative housing having a front mating face and a rear conductor-receiving face. A conductive shell is disposed about at least a portion of the housing and has an aperture near the rear of the housing. A pair of conductive shield halves enclose the rear conductor-receiving face of the housing and define a cavity extending rearwardly therefrom. The shield halves have engagement means at front ends thereof for engaging beneath a portion of the shell proximate the aperture therein as the shield halves are rotated about the engagement means to form the cavity. The shield halves include cable-embracing means at rear ends thereof.

The invention contemplates the provision of complementary interengaging fulcrum means operatively associated between the shield halves intermediate the front and rear ends thereof. The shield halves pivot about the fulcrum means as the shield halves are rotated relative to the engagement means, so that the engagement means are urged outwardly to positively contact the portion of the shell to assure an electrical connection between the shield halves and the shell.

As disclosed herein, the engagement means are provided by hooks projecting forward from the front ends of the shield halves and engageable within the aperture. Latch means are operatively associated between the shell halves to hold the shell halves in preassembled condition, with the engagement means in engagement with the shell, but with the shield halves not fully pivoted about the fulcrum means.

One of the shield halves includes a top wall and at least one side wall, and the other shield half includes a bottom wall and a side wall juxtaposed inside the side wall of the one shield half. The fulcrum means include a projection formed on an edge of the side wall of the other shield half and protruding into an aperture located at the juncture of the top and side walls of the one shield half. The aperture has a given width, and the projection has a base portion wider than the width of the aperture.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
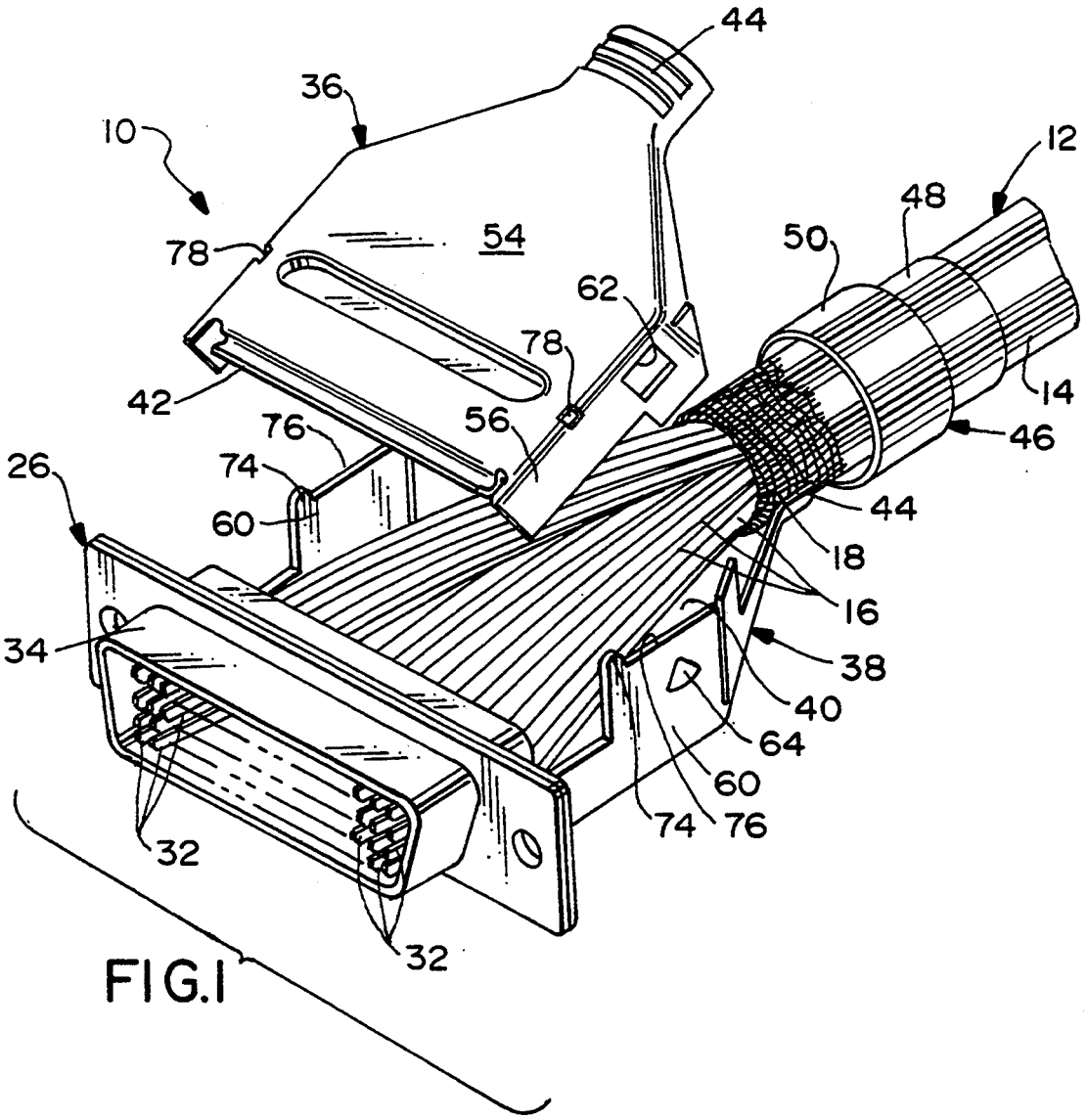
FIG. 1 is a perspective view of a shielded electrical connector embodying the concepts of the invention, with the top shield half removed to facilitate the illustration.
Figure 2:
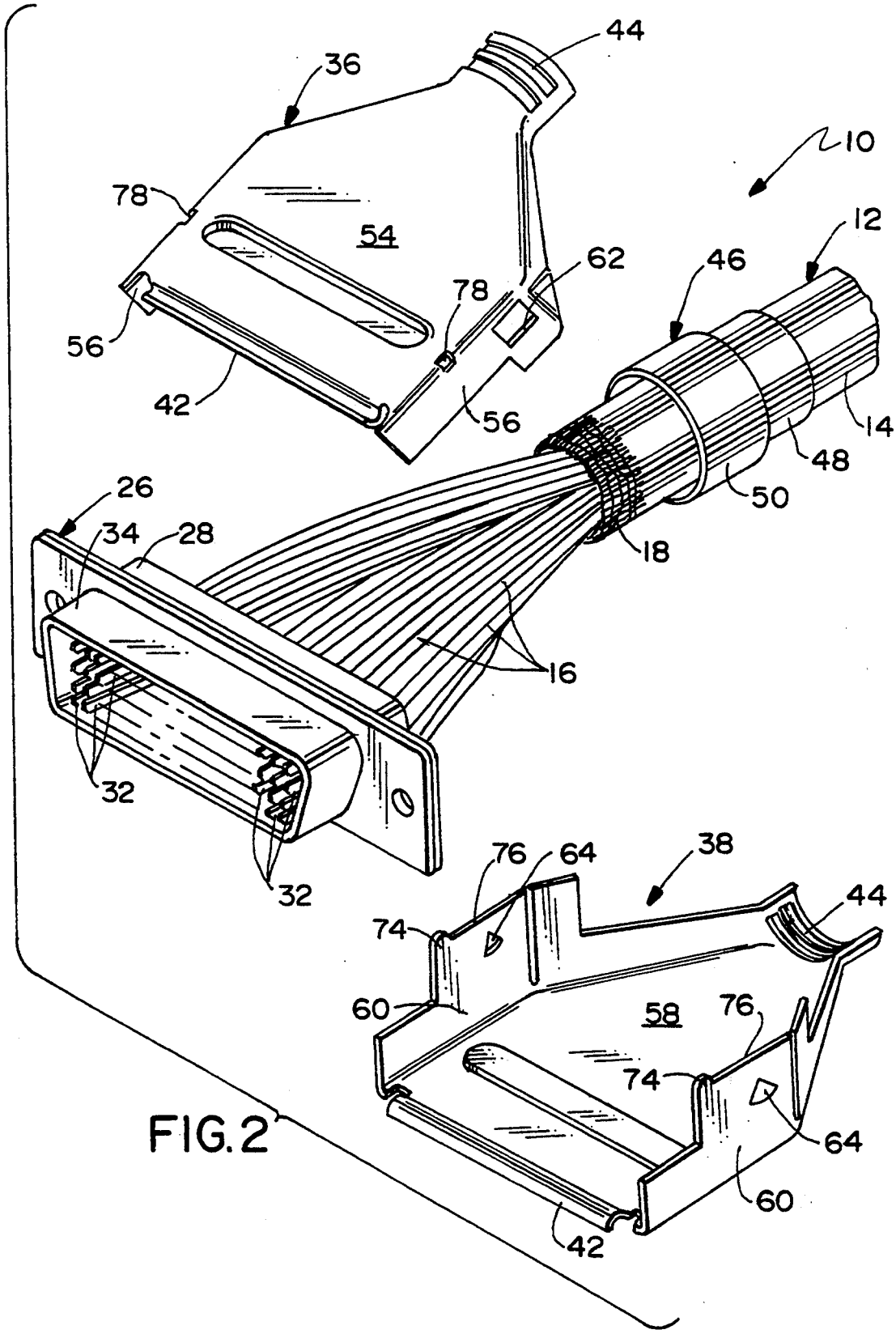
FIG. 2 is an exploded perspective view of the shielded electrical connector.

Referring to the drawings in greater detail, and first to FIGS. 1 and 2, the invention is embodied in a shielded electrical connector, generally designated, for interconnection to a multi-conductor cable, generally designated 12. The cable includes an outer insulating cladding 14, a plurality of interior wires or conductors 16 and a shield 18 therebetween. Shield 18 is shown in the drawings as being folded back over a cut-off end of insulating cladding 14, with the conductors projecting forwardly thereof.

Generally, shielded electrical connector 10 includes an insulative housing, generally designated 20, the housing having a front mating face 22 and a rear conductor-receiving face 24. A conductive shell, generally designated 26, has a rear shroud portion 28 about at least a portion of housing 20 (FIG. 5) and having an aperture 30 near the rear face 24 of the housing. A plurality of terminals 32 are mounted in housing 20 and project forwardly into a mating portion 34 of shell 26.

Connector 10 further includes a pair of conductive shield halves, generally designated 36 and 38, which enclose the rear conductor-receiving face of housing 20 and define a cavity 40 extending rearwardly therefrom. The shell halves include engagement means in the form of elongated hooks 42 at front ends of the shell halves and cable-embracing means in the form of collar portions 44 at rear ends of the shell halves. A crimping ferrule, generally designated 46, is located behind shield halves 36 and 38. The ferrule includes a rear cylindrical portion 48 for crimping onto cable 12, and a forward enlarged cylindrical portion 50 for crimping about collar portions 44 of shield halves 36 and 38 and trapping the cable shield 18.

In order to facilitate a clear and concise understanding of the disclosure, the one shield half 36 will be described herein and in the claims hereof as a "top" shield half, and the other shield half 38 will be referred to as the "bottom" shield half. However, it should be understood that these terms are in no way intended to be used in a limiting manner, because the connector is omnidirectional in its use and purpose.

Figure 3:
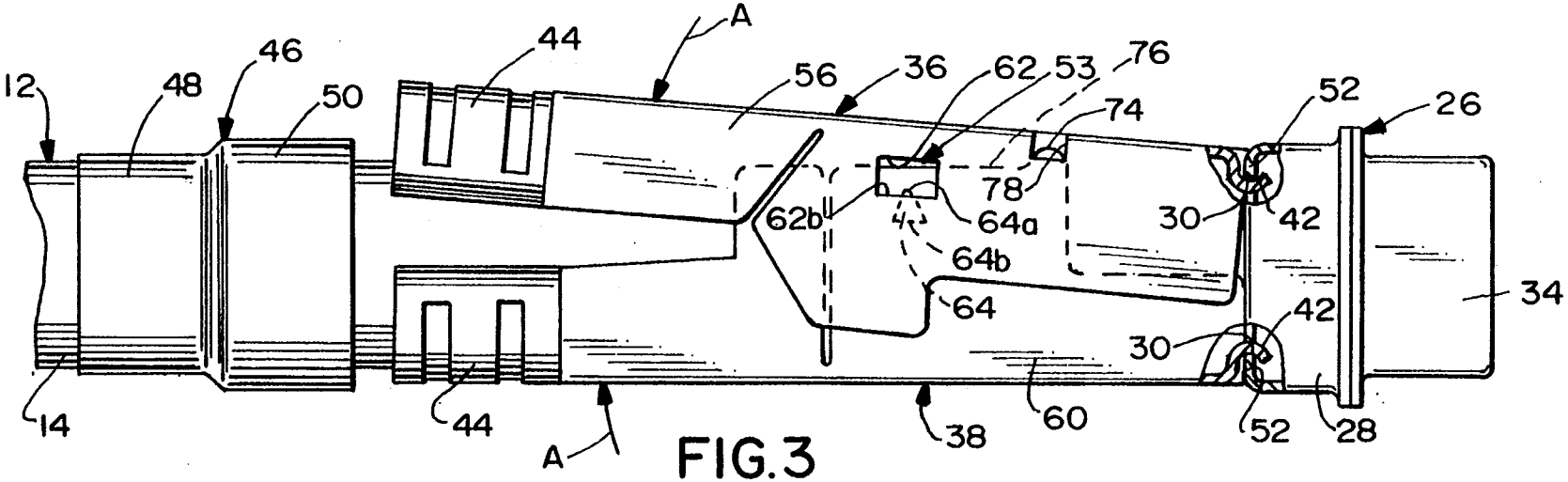
FIG. 3 is a side elevational view of the connector, with the top shield half in an initial position of engagement with the shell.

Referring to FIG. 3 in conjunction with FIGS. 1 and 2, aperture 30 at the rear of shell 26 actually is formed by inwardly turned lips 52 beneath which elongated hooks 42 of shield halves 36 and 38 engage, as is clearly shown in FIG. 3. Therefore, the shield halves can rotate about the interengagement means defined by hooks 42 and lips 52 in the direction of arrows "A". The position of the shield halves in FIG. 3 can be considered the initial position of engagement thereof relative to shell 26.

Figure 4:
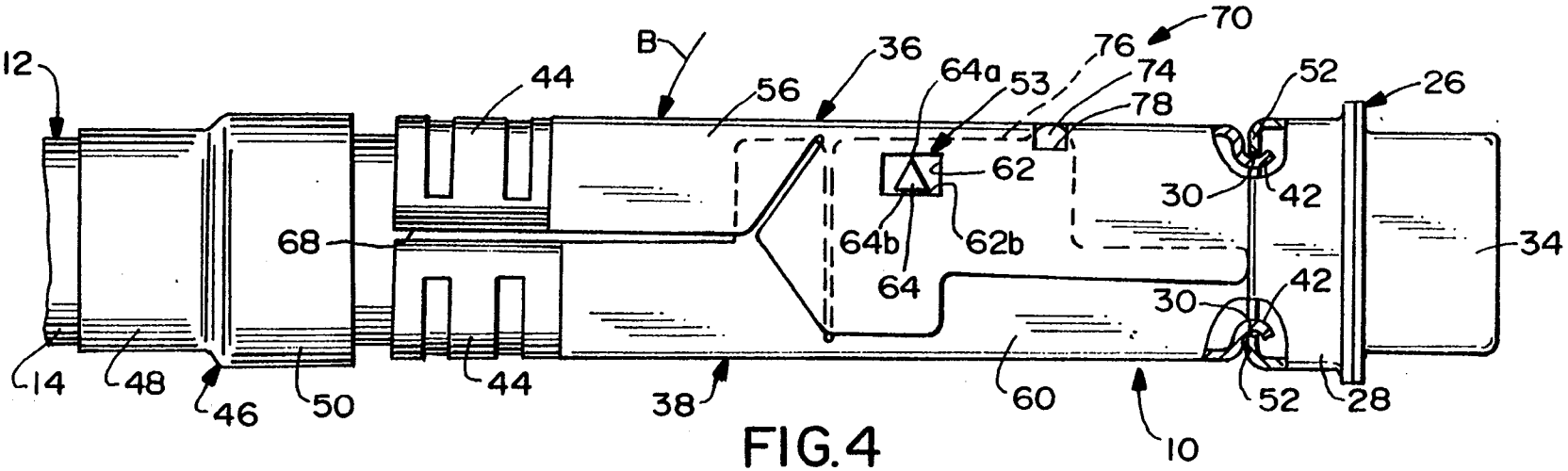
FIG. 4 is a view similar to that of FIG. 3, with the top shield half in a preassembled, latched position relative to the bottom shield half.

Referring to FIG. 4 in conjunction with FIGS. 1–3, top shell half 36 has been rotated further toward bottom shell half 38 in the direction of arrow "B" (FIG. 4). Again, shell half 36 is rotated about the interengagement between its elongated hook 42 and the respective lip 52 of shell. 26. The position of the shield halves in FIG. 4 can be considered the preassembled and/or latched condition of the connector.

Specifically, latch means, generally designated 53, are provided to hold shield halves 36 and 38 in the condition of FIG. 4. The shield halves are fabricated of stamped and formed sheet metal material. Upper shield half 36 includes a top wall 54 (FIG. 1) and a pair of substantially identical side walls 56. Bottom shield half 38 includes a bottom wall 58 (FIG. 2) and a pair of substantially identical side walls 60. The latch means includes an aperture 62 stamped out of each side wall 56 of upper shield half 36, and a latch detent 64 formed in each side wall 60 of bottom shield half 38. The latch detents are formed in triangular configurations so that they define apexes **64*a* pointing upwardly toward upper shield half 36 and bottom linear edges 64*b* for snapping into latching engagement with the bottom edges 62*b* of apertures 62. It can be seen that in this pre-assembled, latched condition of shield halves 36 and 38, the shield halves are not necessarily fully rotated toward each other, as indicated by a gap 68 (FIG. 4) between the shield halves at the rear ends thereof between collar portions 44. An alternative configuration would utilize hermaphroditic shield halves in which each shield half would have one aperture 62 and one detent 64**.

Figure 5:
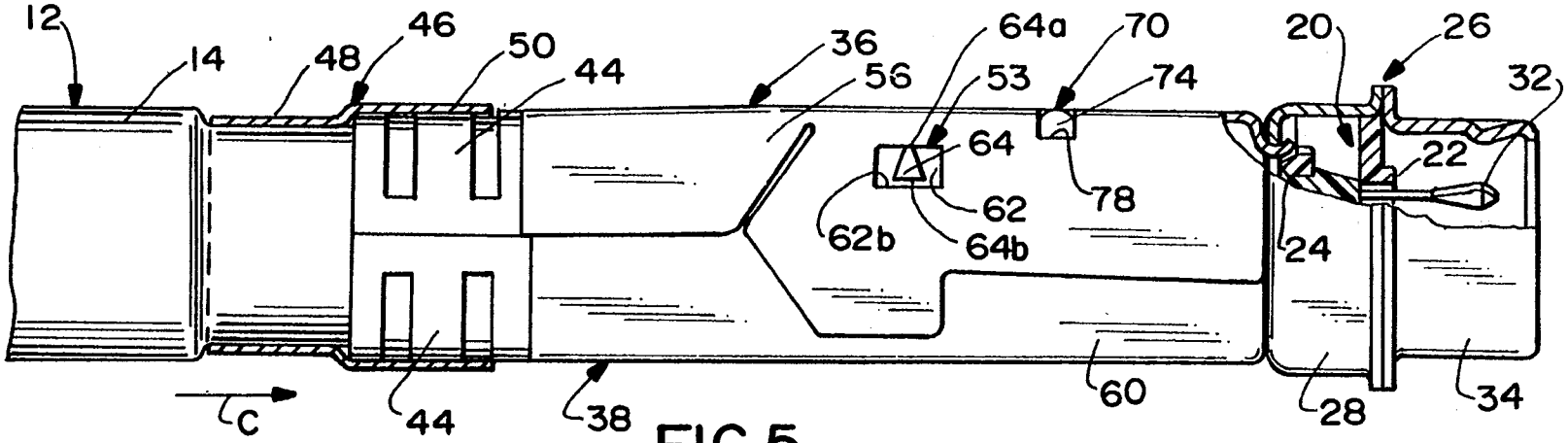
FIG. 5 is a view similar to that of FIG. 4, with the shield halves in fully assembled condition and a portion of the shell and housing broken away.

As best seen in FIGS. 4 and 5, it should be noted that the height of aperture 62 is greater than the height of latch detent 64. The apertures 62 and latch detents 64 are dimensioned and positioned such that upon rotating the shield halves 36 and 38 into their partially assembled position shown in FIG. 4, the detents 64 are snapped into apertures 62 with the bottom edge **64*b* of detent 64 adjacent the bottom edge 62*b* of the aperture. The interengagement of detent 64 and apertures 62 as well as the interengagement of elongated hooks 42 and lips 52 of shell 26 secure the shield halves to the shell in the partially assembled position shown in FIG. 4. Since the height of the detent 64 is less than the height of the aperture 62 and the bottom edges of the detent and apertures are adjacent each other, a gap exists between the top edge of the aperture and the apex 64*a* of the detent. Accordingly, as the shield halves 36 and 38 are further rotated to the position shown in FIG. 5, the detent 64 is able to move upward within aperture 62. In the fully assembled position shown in FIG. 5, the detent 64 may be positioned within aperture 62 so that the apex 64*a* is in contact with the top edge of aperture 62 in order to prevent overrotation of the shield halves 36 and 38 relative to each other, but such structure is not necessary. In the alternative, the detents 64 and apertures 62 could be dimensioned to lock the shield halves together in the fully assembled condition shown in FIG. 5**.

Complementary interengaging fulcrum means, generally designated 70 in FIGS. 4 and 5, are operatively associated between shield halves 36 and 38 intermediate the front and rear ends thereof, for pivoting the shield halves about the fulcrum means from the preassembled latched condition of FIG. 4 to the fully assembled condition of FIG. 5. Specifically, reference is made to FIG. 5 wherein it can be seen that shield halves 36 and 38 have been rotated and pivoted toward each other to an extent that their rear collar portions 44 are closed, as at 72, and crimp ferrule 46 has been moved forwardly in the direction of arrow "C". Rear cylindrical portion 48 of the crimp ferrule can be crimped onto cable 12, as shown, and forward enlarged cylindrical portion 50 of the crimp ferrule can be crimped onto collar portions 44 of the shield halves.

Figure 7:
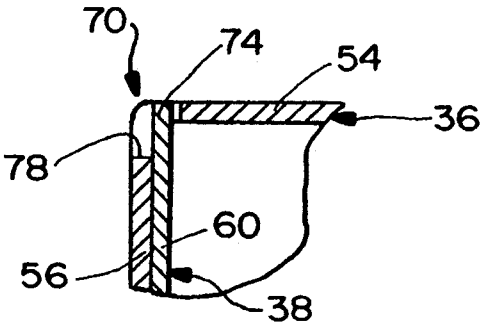
FIG. 7 is a vertical section taken generally along line 7—7 of FIG. 6.
Figure 6:
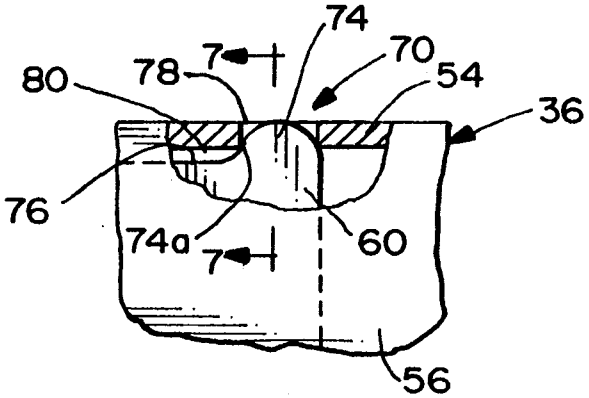
FIG. 6 is an enlarged, fragmented elevational view of the area of the fulcrum means, with a portion of one of the shield halves broken away to facilitate the illustration.

Referring specifically to FIGS. 5–7, fulcrum means 70 includes a projection 74 protruding upwardly from a top edge 76 (FIG. 6) of each side wall 60 of bottom shield half 38. When assembled, as best seen in FIG. 7, each projection protrudes into a generally rectangular aperture 78 stamped in upper shield half 36 at the juncture between each side wall 56 and the top wall 54 thereof. Each aperture 78 has a given width as seen best in FIG. 6. However, each projection 74 has a base portion **74*a* which is wider than the width of the aperture. Therefore, top edge 76 of side wall 60 of bottom shield half 38 is spaced from the inside of top wall 54 of top shield half 36, as seen at 80 in FIG. 6. The interengagement of the projection, particularly at its wider base portion 74*a*, in aperture 78 provides a fulcrum means about which the two shield halves can pivot to force hooks 42 into positive or further tight engagement with lips 52 of conductive shell 26. The interengagement of the projections 74 in the apertures 78** also prevent the shield halves from relative front-to-rear movement.

FIG. 7 shows how apertures 78, being provided at the junctures of side walls 56 and top wall 54 of top shield half 36, allows projections 74 to protrude into the apertures, with side walls 60 of bottom shield half 38 maintained immediately adjacent side walls 56 of top shield half 36. As stated above, the shield halves are fabricated of stamped and formed sheet metal material. The material may be as thin as 0.016 inch. Absent aperture 78, a radius would exist at the juncture between each side wall 56 and top wall 54 of upper shield half 36. With such a structure, upon assembling the shield halves 36 and 38, the projections 74 would engage the radius of each juncture, thus potentially bending the projections inwardly and, possibly, defeating their purpose as a fulcrum means.

In assembly of shielded electrical connector 10, crimp ferrule 46 first is telescoped over cable 12, the cable being prepared either before or after receiving the ferrule as seen in FIGS. 1 and 2, such that insulating cladding 14 is cut back to expose lengths of conductors 16, and shield 18 is peeled back over the insulating cladding. The conductors then are terminated to terminals 32 mounted in insulative housing 20. Shield halves 36 and 38 are interengaged with the rear end of shell 26, as seen in FIG. 3, with hooks 42 of the shield halves positioned beneath lips 52 of the shell. The shield halves then are rotated about the engagement between hooks 42 and lips 52 to a preassembled latched condition as shown in FIG. 4, with latch detents 64 snappingly latched within apertures 62. The shield halves then are pivoted about fulcrum means 70 to their fully assembled condition as shown in FIG. 5, whereupon crimp ferrule 46 can be moved forwardly and crimped onto collar portions 44 of the shield halves and insulating cladding 14 of cable 12. In the final assembled condition of the shield halves, hooks 42 are further forced tightly or positively into engagement with lips 52 of shell 26 as the shield halves are pivoted about the fulcrum means.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A shielded electrical connector assembly adapted to engage a shielded cable having an outer cable braid for shielding the cable, the connector assembly including:

an insulative housing with terminal receiving regions;

a plurality of terminals mounted in the housing;

a conductive housing shell mounted on the housing;

upper and lower conductive shield halves, each having a housing shell engaging end for engaging a portion of said conductive housing shell; and a rear cable engaging end for electrically and mechanically engaging said cable braid;

said shield halves being movable from an initial position at which said cable engaging ends are spaced apart to a final position at which said cable engaging ends are adapted to engage said cable braid;

the improvement comprising:

a projection on one shield half between the housing shell engaging end and the rear cable engaging end; and means defining a pivot region on the other shield half between the housing shell engaging end and the rear cable engaging end interengaging said projection and about which said shield halves pivot relative to one another between said initial and final positions in order to increase the force of engagement between said housing shell engaging ends and the conductive housing shell upon rotating said shield halves between said initial and final positions.

2. In a shielded electrical connector as set forth in claim 1, further comprising shell engaging members projecting forward from the housing shell engaging ends of the shield halves and engageable beneath inwardly projecting lip means of said shell.

3. In a shielded electrical connector as set forth in claim 1, wherein said projection protrudes into an aperture in the other shield half, a base portion of the projection being wider than the width of the aperture.

4. In a shielded electrical connector as set forth in claim 1, wherein said shield halves are stamped and formed of sheet metal material and include a wall having the projection thereon.

5. In a shielded electrical connector as set forth in claim 4, wherein said other shield half includes a top wall and a side wall, one shield half includes a bottom wall and a side wall juxtaposed inside the side wall of the one shield half, said projection being formed on an edge of the side wall of the other shield half, and said aperture being located proximate the juncture of the top and side wall of the other shield half for receiving the projection.

6. In a shielded electrical connector as set forth in claim 5, wherein each shield half includes a pair of side walls, the other shield half includes a pair of said apertures, and the one shield half includes a pair of said projections.

7. In a shielded electrical connector as set forth in claim 5, wherein each aperture has a given width and each projection has a base portion wider than the width of the aperture.

8. In a shielded electrical connector as set forth in claim 1, including latch means operatively associated between the shield halves to hold the shield halves in a preassembled condition with the front ends of the shield halves in engagement with the shell, but with the shield halves not fully pivoted about the pivot region.

9. A shielded electrical connector for interconnection to a shielded cable, comprising:

an insulative housing having a rear face and mounting a plurality of terminals;

a conductive shell enclosing at least a portion of the housing and having an aperture adjacent the rear face of the housing;

first and second conductive shield halves each having a front end and a rear end, a pivot hook projecting forwardly from the front end of each shield half for electrically and mechanically engaging a portion of the conductive shell adjacent said aperture, and about which at least one of said shield halves is initially rotated in a first pivotal movement; and a fulcrum projection on the first shield half between the pivot hook and rear end thereof and engageable with a pivot region on the second shield half to define a fulcrum means about which the shield halves pivot relative to each other in a second pivotal movement to increase the force of engagement between the pivot hooks with said portion of the conductive shell as the shield halves are pivoted about the fulcrum means.

10. The shielded electrical connector of claim 9 wherein said pivot region on the second shield half comprises an aperture into which the fulcrum projection protrudes.

11. The shielded electrical connector of claim 10 wherein said aperture has a given width, and the fulcrum projection has a base portion wider than the width of the aperture.

12. The shielded electrical connector of claim 11 wherein said second shield half includes a top wall and a side wall, the first shield half includes a bottom wall and a side wall juxtaposed inside the side wall of the second shield half, said fulcrum projection is formed on an edge of the side wall of the second shield half, and said aperture is located at the juncture of the top and side walls of the first shield half.

13. The shielded electrical connector of claim 9, including latch means operatively associated between the shield halves to hold the shield halves in preassembled condition with the pivot hook engaging said portion of the conductive shell, but with the shield halves not fully pivoted about the fulcrum projection.

14. A method of assembling a shielded electrical connector for interconnection to a multi-conductor cable, the connector including a conductive shell having a conductor-receiving aperture near a rear end thereof, a pair of conductive shield halves defining a cavity extending rearwardly of the conductive shell, and engagement means at the front ends of the shield halves for engaging a portion of the conductive shell proximate said aperture, comprising the steps of:

providing complementary interengaging fulcrum means operatively associated between the shield halves intermediate the front and rear ends thereof, said complementary interengaging fulcrum means including a projection on one shield half and means defining a pivot region on the other shield half for interengaging said projection and about which said shield halves pivot relative to one another in order to increase the force of engagement between said conductive shell and the engagement means of said shield halves;

rotating the shield halves about said engagement means to form said cavity and whereby said projection interengages said pivot region; and pivoting the shield halves about said fulcrum means so that said engagement means are urged outwardly to positively contact said portion of the conductive shell to assure an electrical connection between the shield halves ad the conductive shell.

15. The method of claim 14, including providing latch means operatively associated between the shield halves, and engaging said latch means as the shield halves are rotated about said engagement means but before pivoting the shield halves about said fulcrum means, to hold the shield halves in a preassembled condition.

* * * * *